US005778490A

United States Patent [19]

Curtis

[11] Patent Number: 5,778,490

[45] Date of Patent: Jul. 14, 1998

[54] TENSION DEVICE FOR LIVE AXLE DOORS

[76] Inventor: David B. Curtis, 962 Bay Springs Rd., Villa Rica, Ga. 30180

[21] Appl. No.: 590,936

[22] Filed: Jan. 24, 1996

[51] Int. Cl.[6] ..... E05F 1/08; E05F 11/54

[52] U.S. Cl. ..... 16/198; 160/191

[58] Field of Search ..... 16/197, 198; 160/191; 49/200

[56] References Cited

U.S. PATENT DOCUMENTS

| | | | |
|---|---|---|---|
| 1,994,142 | 3/1935 | Medsen | 16/198 |
| 2,032,951 | 3/1936 | Pixley | 160/191 |
| 2,059,833 | 11/1936 | Winn, Jr. | 16/198 |
| 2,066,558 | 1/1937 | Dautrick | 160/191 |
| 2,226,017 | 12/1940 | Pixley | 16/198 |
| 2,630,597 | 3/1953 | Robinson | 160/191 |
| 2,660,753 | 12/1953 | Moler | 16/198 |
| 2,786,712 | 3/1957 | Whiting | 160/191 |
| 2,932,057 | 4/1960 | Pemberton | 16/198 |
| 3,839,827 | 10/1974 | Dickinson | 49/197 |
| 4,356,668 | 11/1982 | Wagner | 49/506 |
| 4,472,910 | 9/1984 | Iha | 49/139 |
| 4,597,224 | 7/1986 | Tucker | 49/199 |
| 4,817,927 | 4/1989 | Martin | 267/155 |
| 4,930,182 | 6/1990 | Eichenberger | 16/198 |
| 4,981,165 | 1/1991 | Miller et al. | 160/191 |
| 5,222,327 | 6/1993 | Fellows et al. | 49/139 |
| 5,239,777 | 8/1993 | Husselton | 49/200 |

*Primary Examiner*—Chuck Mah
*Assistant Examiner*—Donald M. Gurley
*Attorney, Agent, or Firm*—Bernstein & Associates

[57] ABSTRACT

A live axle tension device (15) that is suitable for adjusting the setting of a spring (16) on a live axle door (10). The tension device comprises a spring (16) that connects to a drum wheel (14) and to a spring connecting plate (22). The spring connecting plate (22) is attached to the outside of an axle housing tube (24) that houses the axle (12). The axle housing tube (24) also has two tension plates (26) connected to it which sandwich a tension bracket (20). The tension bracket (20) is fixedly attached to a supporting structure (21) and the axle (12) is free to rotate inside the bracket. The axle housing tube (24) and the plates attached to it can rotate relative to the tension bracket (20). With the spring (16) connected to the drum wheel (14) at one end and connected to the spring connecting plate (22) at the other end, the insertion of a tension pin (32) through the tension plates (26) and the tension bracket (20) fixes the position of the two ends of the spring (16) relative to each other. With the tension pin (32) in place, the door (10) can be raised and lowered in order to determine if the tension in the spring (16) is correct. If the tension in the spring (16) needs to be adjusted, a pipe wrench or other tool is attached to the outside of the axle housing tube (24) and the tube (24) is turned slightly to release the force on the tension pin (32) so that it can be removed. With the tension pin (32) removed, the axle housing tube (24) can be rotated in either direction by the wrench to increase or decrease the tension of the spring (16). Once the desired amount of tension is achieved, the tension pin (32) is placed back through the tension plates (26) and the tension bracket (20). At this point the door (10) can be raised and lowered again to determine if the spring (16) is adjusted properly.

25 Claims, 3 Drawing Sheets

TENSION DEVICE FOR LIVE AXLE DOORS

BACKGROUND OF THE INVENTION

I. Field of the Invention

The present invention relates to devices for applying tension to a rollup door, such as rollup doors that are commonly used in warehouses and mini-storage facilities.

II. Background of the Art

A live axle roll up door is a door comprised of flexible material that raises and lowers by means of a rotating axle located above the door frame. The door is typically attached at an end to a set of drum wheels that rotate with the axle. As the axle rotates, the door rolls up onto the drum wheels. If the direction of rotation of the axle is reversed, the door rolls off of the drum wheel and travels downward to close. In warehouses and mini-storage facilities it is common to place a live axle roll up door at the opening to the building. These doors are usually relatively lightweight and designed to be easily and quickly retracted either manually or automatically. In order to allow for manual operation of the door, a coil spring is usually installed at the top of the door to counterbalance the weight of the door. The coil spring is usually disposed around a shaft and fixed to the shaft at one end such that the spring rotates with the shaft, and fixed to a stationary structure at the other end. The torsional forces created in the spring by the rotation of the shaft provide a variable torque which counteracts the weight of the door. As the door is lowered, the torsional forces developed in the spring pull in the opposite direction of the travel of the door. The amount of tension resulting from the torsional forces generated in the coil spring will determine the performance characteristics of the door. If there is too little tension, the weight of the door may cause the door to drift down from the open position to the closed position. If the tension is too great, the door may be hard to pull down and it may not stay closed. Also, a door with too much tension in the spring will fly up upon exertion of an upward force to open the door. If the amount of tension is set correctly, the door can be lowered gently and a balance will be struck between the weight of the door and the force exerted by the spring. At certain positions, the weight of the door may balance with the force of the spring and the door can be left partially open. In the closed position, the weight of the door will overcome the force of the spring and the end of the door will rest on the ground. Also, if the door is adjusted properly, a small amount of upward force will release the potential energy of the spring and the door will easily travel in the vertical direction.

In the existing devices used for most warehouses and mini-storage facilities, a live axle door is typically installed which allows the door to travel vertically and then roll up above the door opening. The live axle is free to rotate within and is supported by brackets on either side of the opening of the door. On one end of the axle, a tension bracket connects to one end of the spring. The other end of the spring is attached to a drum wheel that rolls the door. The drum wheel rotates with the axle and the end of the door is attached to the drum wheel. As the axle turns, the door, which is constructed of a sectional material that is flexible enough to roll up, rolls onto the drum wheels.

In the standard configuration, the following procedure is required to adjust the spring for the door. The tension bracket usually has four holes set equidistant around the hole for the axle. First, the door typically comes from the manufacturer already rolled up and strapped or otherwise braced to prevent it from unrolling. The coil spring is fixed to the drum wheel at one end and the other end is bolted to one of the holes on the tension bracket. Next, the rolled up door is rotated, in the same direction as it would rotate when the door is traveling downward, to achieve the approximate amount of preset tension that is required for the particular door. The straps are then cut, and the door is lowered in order to test the setting of the spring. If the tension on the spring is not adjusted properly, the door has to be rolled back up and tied again. With the door tied, the preset tension is removed by rotating the door in the opposite direction from the direction that the rolled up door was originally rotated. The spring is then unbolted from the tension bracket and adjusted. The tension of the spring is adjusted by turning the spring in either direction and bolting it to the next hole on the tension bracket. Because there are typically four holes, the adjustment is usually limited to a quarter of a turn of the spring.

The primary drawbacks to the existing devices include the amount of time required to adjust the spring, the limited range of adjustability, and the possibility of injury. The procedure detailed above for adjusting the spring takes approximately fifteen minutes per adjustment and the range of adjustment is only a quarter of a turn resulting in extended time to install the door and a limited ability to acceptably counterbalance the door. Also, the requirement of bolting and unbolting a spring that may be under some torsional forces raises the possibility of injury to the hands while working on the spring.

Some attempts have been made to address the problems discussed above for adjusting the preset tension on a coil spring used with overhead door assemblies typically used in warehouses or garages. However, these attempts have introduced a level of expense and complexity which has been a significant drawback. For instance, U.S. Pat. No. 4,981,165 issued to Miller et al. discloses a gearing mechanism which allows the spring torsion to be adjusted by a worm gear drive without releasing the spring from the adjustment mechanism. The adjustment mechanism is attached to the rotating shaft and holds the end of the spring. This device, by connecting the adjustment mechanism to the rotating shaft and utilizing a worm gear drive, introduces complexity which is obviated by the present invention.

U.S. Pat. No. 4,930,182, issued to Eichenberger, discloses a spring tensioning apparatus which also positions the adjustment mechanism on the rotating shaft. Instead of a worm gear drive, the Eichenberger apparatus utilizes a spring winding assembly that can be rotated by the insertion of a rod like tool into a spoke to provide torque to increase or decrease the torsion of the spring. Again, the adjustment mechanism is positioned on the rotating shaft with set screws.

Accordingly, there is a need for a spring tension adjustment mechanism that provides a quicker, more precise, simpler and safer adjustment of the springs associated with overhead door assemblies.

SUMMARY OF THE INVENTION

The present invention provides a device for adjusting the tension on a live axle roll up door.

Generally described, the present invention provides a tension device comprising an axle housing tube having plates attached to it that rotate relative to a tension bracket. A tensioning pin is inserted through the plates and the fixed tension bracket to preset the tension on a coil spring for a live axle door.

In a preferred embodiment, the present invention comprises a spring that is connected at one end to a drum wheel on the axle of the door. The other end of the spring is connected to a spring connecting plate. The live axle of the door rotates freely within the axle housing tube. A pair of tension plates are also attached to the outside of the axle housing tube. A tension bracket also fits over the axle housing tube and is sandwiched between the tension plates. The tension bracket is not connected to the axle housing tube and thus, the axle housing tube is free to rotate relative to the tension bracket. The tension bracket is normally fixedly attached to the wall next to the opening in the building. A tension pin is inserted through holes in the tension plates to fix the position of these plates relative to the tension bracket which in turn fixes the amount of tension preset in the spring. The initial tension in the spring determines the performance characteristics of the door because additional tension is added to the spring through torsion as the door is rolled down. The amount of tension that is developed in the spring during the lowering of the door depends to a great extent on the amount of tension preset in the spring.

In order to preset the tension on the spring, the spring is fixedly attached to the drum wheel at one end and attached to the fixed tension bracket through the spring attaching plate at the other end. With the door rolled up and strapped or braced to prevent it from unrolling, the door is rotated, in the same direction as it would rotate if the door were traveling downward, to achieve the approximate amount of preset tension required for the particular door. In order to test the tension level on the spring the door is untied and raised and lowered in its normal operation. If the tension is too great the door will fly up, and if the tension is too low the door may drift downward. In order to adjust the tension on the door a pipe wrench or other suitable tool is placed on the end of the axle housing tube and the axle housing tube is rotated slightly to take some of the tension off of the spring. With some of the tension removed from the spring, the tension pin can be removed from the holes in the tension plates. Once the tension pin is removed, the axle housing and the plates can be rotated relative to the tension bracket. The axle housing can be turned in either direction depending on whether the spring needs to be twisted more or less. The tension plates have a series of holes around their perimeter and the tension bracket has a set of holes to mate with the holes on the tension plates. These holes provide for fine adjustments to the tension on the spring on the order of an eighth of a turn of the spring. After the axle housing is rotated and the holes in the tension plates are lined up with the holes in the tension bracket, the tension pin can be reinserted and the door can again be operated normally to determine if the spring has been adjusted properly.

Accordingly, it is an object of the present invention to provide a tension adjusting device for a live axle roll up door that reduces the amount of time required to adjust the tension on the spring correctly.

It is another object of the present invention to provide a tension adjusting device for a live axle roll up door that provides greater adjustability of the tension of the spring on the door.

It is yet another object of the present invention to reduce the risk of injury from coming into contact with the spring by eliminating the need to place the hands near the spring while it is under tension.

It is a further object of the present invention to provide a simple device for adjusting the tension on a coil spring for a live axle door.

It is another object of the present invention to provide a door tensioning device which is capable of fine adjustment.

It is an additional object of the present invention to provide a door tensioning device which is capable of quick adjustment without disconnecting the spring from the tensioning device.

It is yet an additional object of the present invention to provide a door tensioning device having a tension bracket, an axle housing tube, a pair of plates attached to the axle housing tube that rotate relative to the tension bracket, a spring connecting plate that is also connected to the live axle housing tube and that rotates relative to the tension bracket, a coil spring connected to the spring connecting plate that is torsioned by the rotation of the spring connecting plate, and a tension pin that fits through the pair of plates and the tension bracket to fix the position of the spring connecting plate thereby fixing the position of one end of the coil spring relative to the other.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
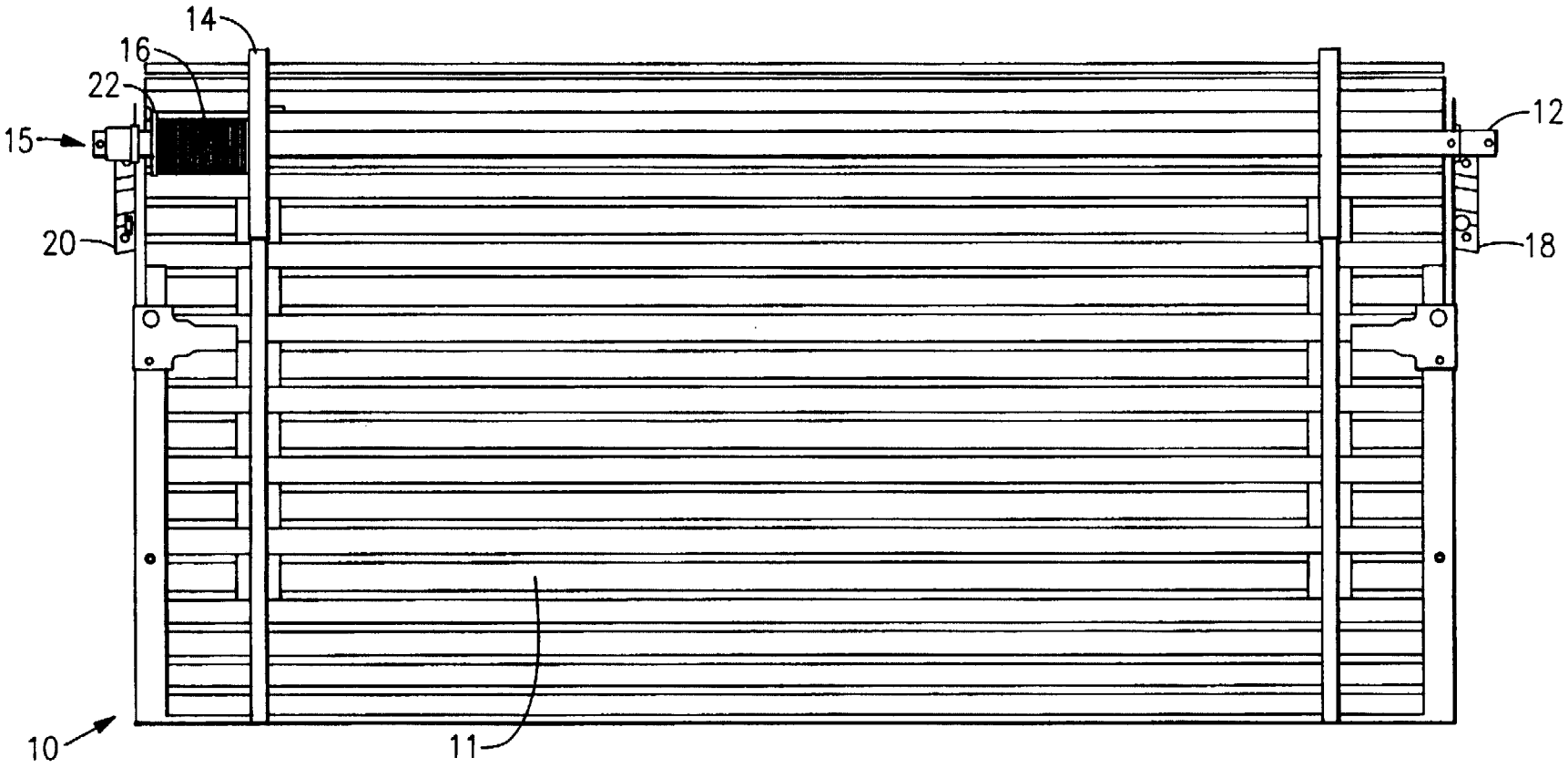
FIG. 1 is an elevation view of the inside of a door that is equipped with the tensioning device of the present invention.

Referring to FIGS. 1–5 generally, and particularly to FIG. 1, a live axle roll up door 10 is typically constructed of a sectional material 11 that is flexible enough for the door to be rolled up in a relatively small diameter roll. A live axle 12 turns a drum wheel 14 which is connected to the end of the door 10. As the axle 12 turns in the clockwise direction, the door 10 rolls onto the drum wheel 14, and the door opens. If the axle 12 is turned counterclockwise, the door 10 rolls off of the drum wheels 14 and down toward the ground.

On the left side of FIG. 1, a tension device 15 is shown which includes a spring 16 that connects to the drum wheel 14 at one end and to a spring connecting plate 22 at the other end. The spring connecting plate 22 is supported by a tension bracket 20. The spring 16 is preferably a coil spring constructed of metal or other suitable material. As the axle 12 turns counterclockwise and the door 10 is lowered, the spring 16 is twisted and torsional forces are generated. The tension of the spring 16 creates a torsional force that counteracts the weight of the door 10. In order for the door 10 to operate correctly, the tension in the spring 16 must be set correctly. The minimum tension of the spring 16 occurs when the door 10 is completely rolled up and the door 10 is fully open. The maximum tension of the spring 16 occurs when the door 10 is touching the ground or fully extended. The starting point or minimum tension on the spring 10 is normally adjusted to get the proper performance from the door 10. If the spring 16 has zero tension at the starting point, the amount of tension when the door 10 is fully extended will be the lowest amount possible. If the spring 16 is preset with tension at the starting point, the tension when the door 10 is fully extended will be increased accordingly.

A standard bracket 18 supports the other end of the axle 12 and allows the axle 12 to rotate freely.

Figure 2:
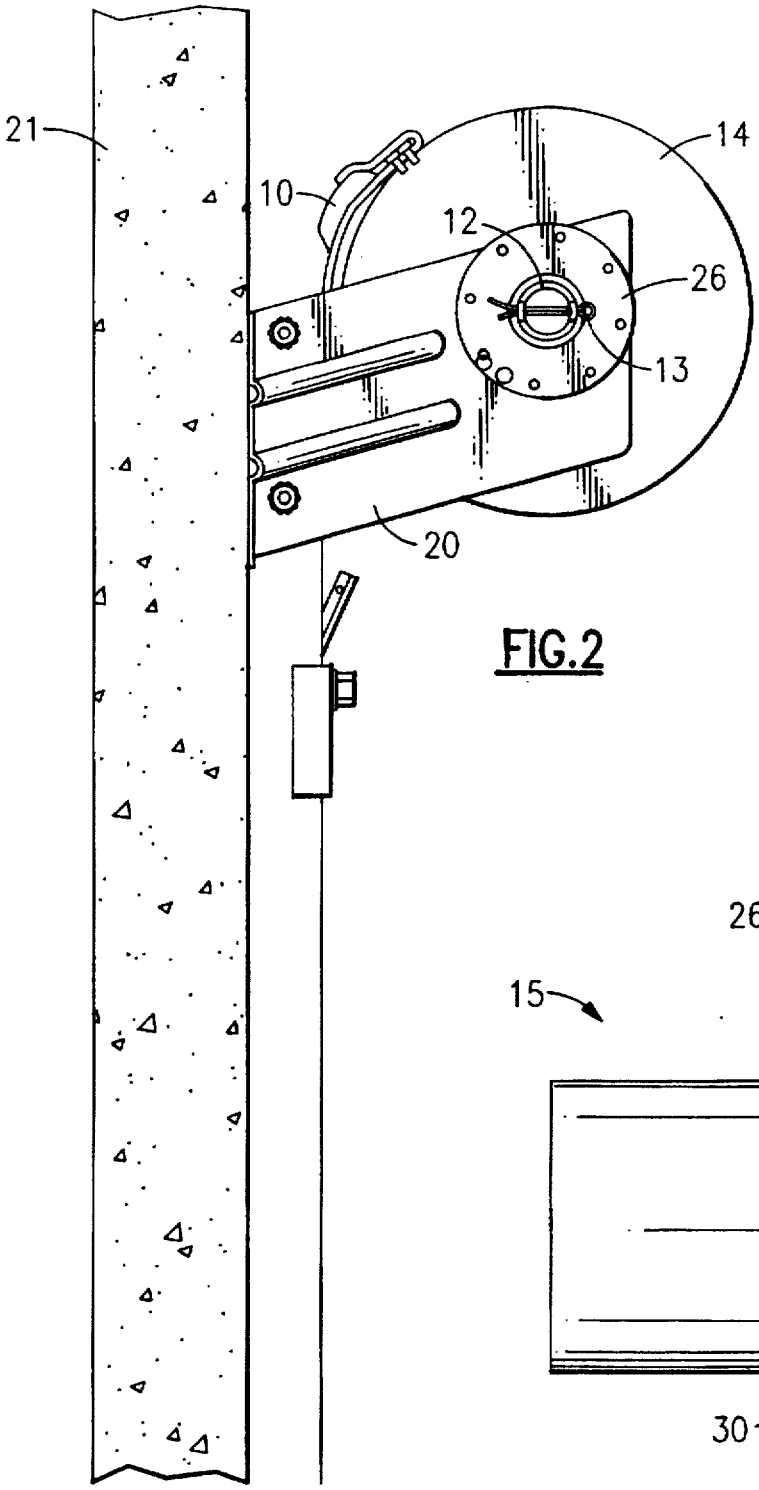
FIG. 2 is a side elevation view of the live axle roll up door illustrating the side of the door with the tension bracket of the present invention.

Referring to FIG. 2, the tension bracket 20 attaches to support structure 21. The end of the axle 12 is held in the axle housing tube 24 by an axle pin 13 which prevents the axle 12 from sliding out.

The end 11 of the door 10 is connected to the drum wheel 14. When the door 10 is raised, the drum wheel 14 rotates clockwise and the door 10 rolls up onto the drum wheel 14.

A tension plate 26 is attached to the axle housing tube 24 and contains a series of holes 34 located around its perimeter.

Figure 3:
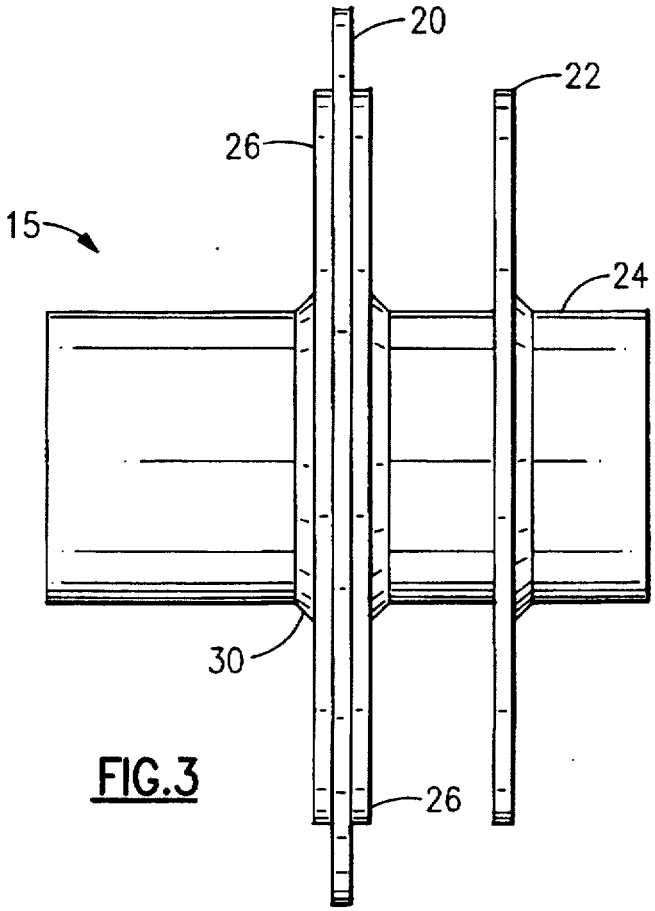
FIG. 3 is a detailed elevation view of the inside of the left side tension device of the present invention.

Turning to FIG. 3, the tension device 15 includes the axle housing tube 24. The axle 12 fits inside the axle housing tube 24 and rotates freely therein. The spring 16 connects to the spring connecting plate 22. The tension plates 26 sandwich the tension bracket 20 which is fixedly attached to the support structure as shown in FIG. 2. The spring connecting plate 22 and the tension plates 26 are all attached to the outside of the axle housing tube 24. The plates 22 and 26 are preferably welded to the outside of the axle housing tube 24, but any suitable means for attaching the plates to the outside of the housing 24 may be used. The tension bracket 20 fits over the axle housing tube 24, and is sandwiched between the tension plates 26. Accordingly, the axle housing tube 24 and the plates 22 and 26 rotate together and are free to rotate relative to the tension bracket 20.

Figure 4A:
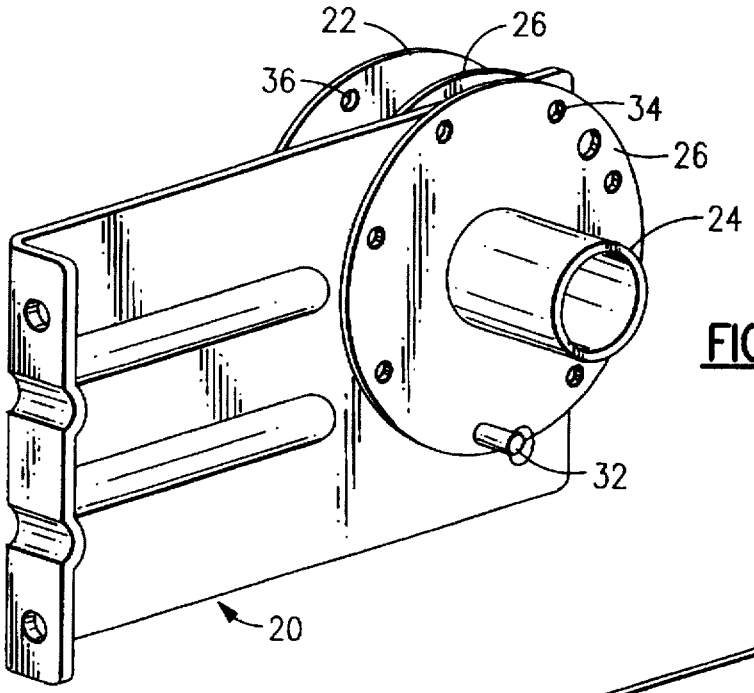
FIG. 4*a* is a perspective view of the tension device of the present invention.

Turning to FIG. 4*a*, the spring 16 (not shown) is bolted to the spring connecting plate 22 through the hole 36. As shown in FIG. 2, the opposite end of the spring 16 is connected to the drum wheel 14. Returning to FIG. 4*a*, the axle housing tube 24 extends beyond the tension plate 26 for approximately several inches in order to allow room for a tool such as a pipe wrench to be attached to the end. The tension pin 32 extends through the tension plates 26 and the tension bracket 20. With the spring 16 bolted to the spring connecting plate 22 at one end and bolted to the drum wheel 14 at the other end, insertion of the tension pin 32 through the tension plate 26 and the tension bracket 20 sets the initial tension of the spring 16 by fixing the position of the two ends of the spring 16 relative to each other. In order to test whether the initial tension of the spring 16 is set properly, the door 10 is lowered. By raising and lowering the door 10, the performance characteristics of the door at the current setting are readily observable. If the tension is not set properly, a pipe wrench (not shown) or other suitable tool is applied to the outside of the axle housing tube and the tube is rotated slightly to take the pressure off of the tension pin 32 for removal. With the tension pin 32 removed, the wrench is used to turn the axle and the plates 26 and 22 in either direction depending on whether the spring needs to be tightened or loosened. Once the new setting is found after rotating the plates, the tension pin 32 is reinserted and the pipe wrench or other tool is removed. At this point the door 10 can be operated normally to determine if the new setting is correct.

Figure 4B:
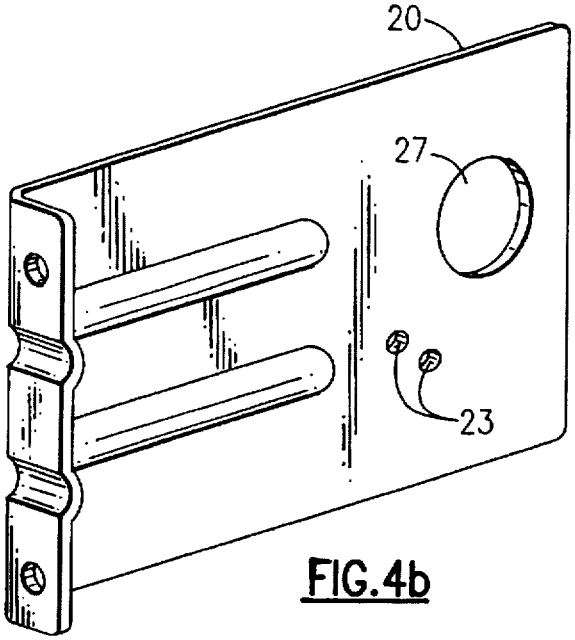
FIG. 4*b* is a perspective view of the tension bracket of the present invention; and, FIG. 5 is a detailed side view of the tension plate of the present invention.

In FIG. 4*b*, the tension bracket 20 alone is shown with holes 23 positioned to align with the holes in the tension plates 26 (shown in FIG. 4*a*). These holes are preferably positioned equidistant from the center of the round opening 27 in the tension bracket 20.

Figure 5:
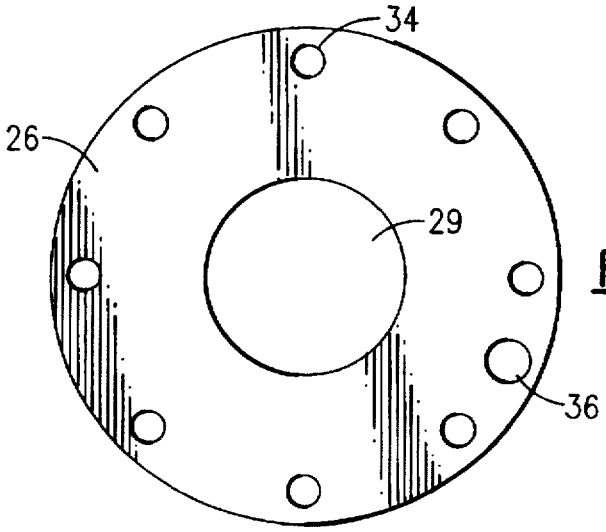

As shown in FIG. 5, the array of holes 34 around the perimeter of tension plate 26 provides the adjustment capability for the spring 16. There are eight holes 34 in the plate 26 which are preferably equally spaced around the perimeter of the plate and therefore, would provide adjustability to one-eighth of a rotation. The holes 34 are equidistant from the center of the opening 29 in the tension plate 26. There are two holes 23 (shown in FIG. 4*b*) in the tension bracket 20 that align with any of the holes 34 in the tension plates and that are spaced apart by one-half of the distance between the holes 34. Thus, the extra hole in the tension bracket allows for a sixteenth of a rotation of adjustability for the spring 16. The range of adjustment of the spring 16 may be increased or decreased by adding or subtracting holes.

Accordingly, the tension device of the present invention offers significant advantages over the prior art devices by providing a simpler device for quickly adjusting the tension of a spring on a live axle door. Also, the device of the present invention greatly reduces the risk of injury as the hands are never required to be near the spring while it is under tension. Further, the device of the present invention provides a greater range of adjustability for the tension of the spring, which in turn provides for optimization of the performance characteristics of the door.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A tensioning device for a roll up door having a live axle, the live axle connected to a set of drum wheels and supported at one end by a fixed bracket attached to a support structure, the tensioning device comprising:

a) a tension bracket having an opening and at least one hole defined therein, the tension bracket fixedly attached to the support structure;

b) an axle housing tube fitting through the opening in the tension bracket;

c) a tension plate fixedly attached to the axle housing tube and positioned adjacent to the tension bracket, the tension plate having a plurality of holes defined therein;

d) a tension pin sized to fit through the holes in the tension plate and through the hole in the tension bracket to prevent rotation of the tension plate relative to the tension bracket e) a spring connecting plate fixedly attached to the axle housing tube so that the tension bracket is between the tension plate and the spring connecting plate; and, f) a coil spring surrounding and extending along the axle having a first end and a second end, the first end connected to the axle and the second end connected to the spring connecting plate.

2. The tensioning device of claim 1, wherein the first end of the coil spring is connected to the axle by attaching the first end of the coil spring to the drum wheel.

3. The tensioning device of claim 1, wherein the tension bracket has a round opening defined therein and the tension bracket has two holes defined therein positioned generally equidistant from the center of the round opening.

4. The tensioning device of claim 1, wherein the axle housing tube extends beyond the opening in the tension bracket on both sides of the bracket.

5. The tensioning device of claim 1, wherein the tension plate has a round opening defined therein and the holes in the tension plate are uniformly spaced, equidistant from the center of the opening, and alignable with the hole in the tension bracket.

6. The tensioning device of claim 5, wherein the tension plate is welded to the axle housing tube.

7. The tensioning device of claim 1, wherein the spring connecting plate is welded to the axle housing tube.

8. The tensioning device of claim 7, wherein the spring connecting plate has a hole defined therein.

9. The tensioning device of claim 8, wherein the coil spring is attached to the hole in the spring connecting plate.

10. A tensioning device for a roll up door having a live axle, the live axle connected to a set of drum wheels and supported at one end by a fixed bracket attached to a support structure, the tensioning device, comprising:

a) a tension bracket having an opening and at least one hole defined therein, the tension bracket fixedly attached to the support structure;

b) an axle housing tube fitting through the opening in the tension bracket;

c) a pair of tension plates fixedly attached to the axle housing tube and positioned on opposite sides of the tension bracket and in juxtaposition therewith, the tension plates having a plurality of holes defined therein;

d) a tension pin sized to fit through the holes in the tension plates and through the hole in the tension bracket to prevent rotation of the tension plates relative to the tension bracket;

e) a spring connecting plate fixedly attached to the axle housing tube; and, f) a coil spring surrounding and extending along the axle having a first end and a second end, the first end connected to the axle and the second end connected to the spring connecting plate.

11. The tensioning device of claim 10, wherein the first end of the coil spring is connected to the axle by attaching the first end of the coil spring to the drum wheel.

12. The tensioning device of claim 10, wherein the opening in the tension bracket is a round opening and the tension bracket has two holes positioned generally equidistant from the center of the round opening.

13. The tensioning device of claim 10, wherein the axle housing tube extends beyond the opening in the tension bracket on both sides of the bracket.

14. The tensioning device of claim 10, wherein each of the tension plates has a round opening and the holes in the tension plates are uniformly spaced equidistant from the center of the opening and alignable with the hole in the tension bracket.

15. The tensioning device of claim 14, wherein the tension plates are welded to the axle housing tube.

16. The tensioning device of claim 10, wherein the spring connecting plate is welded to the axle housing tube.

17. The tensioning device of claim 16, wherein the spring connecting plate has a hole defined therein.

18. The tensioning device of claim 17, wherein the coil spring is attached to the hole in the spring connecting plate.

19. A tensioning device for a roll up door having a live axle, the live axle connected to a set of drum wheels and supported at one end by a fixed bracket attached to a support structure, the tensioning device comprising:

a) a tension bracket having a round opening and at least one hole defined therein, the tension bracket fixedly attached to the support structure;

b) a round axle housing tube fitting through the opening in the tension bracket and extending beyond the opening in the tension bracket on both sides of the tension bracket, the axle housing tube having the ability to rotate relative to the tension bracket;

c) a pair of tension plates fixedly attached to the axle housing tube and positioned on opposite sides of the tension bracket and in juxtaposition therewith, the tension plates having a plurality of holes defined therein;

d) a tension pin sized to fit through the holes in the tension plates and through the hole in the tension bracket to prevent rotation of the tension plates relative to the tension bracket;

e) a spring connecting plate, the spring connecting plate fixedly attached to the axle housing tube; and, f) a coil spring surrounding and extending along the axle having a first end and a second end, the first end connected to the drum wheel on the axle and the second end connected to the spring connecting plate.

20. The tensioning device of claim 19, wherein the tension bracket has two holes positioned equidistant from the center of the round opening.

21. The tensioning device of claim 19, wherein the tension plates have a round opening defined therein and the holes in the tension plate are uniformly spaced equidistant from the center of the opening and alignable with the hole in the tension bracket.

22. The tensioning device of claim 21, wherein the tension plates are welded to the axle housing tube.

23. The tensioning device of claim 19, wherein the spring connecting plate is welded to the axle housing tube.

24. The tensioning device of claim 23, wherein the spring connecting plate has a hole.

25. The tensioning device of claim 24, wherein the coil spring is attached to the hole in the spring connecting plate.

* * * * *